US007588480B2

(12) United States Patent
Kuebler

(10) Patent No.: US 7,588,480 B2
(45) Date of Patent: Sep. 15, 2009

(54) POLISHING HEAD FOR A POLISHING MACHINE

(75) Inventor: Christoph Kuebler, Oberkochen (DE)

(73) Assignee: Carl Zeiss Vision GmbH, Oberkochen (DE)

( * ) Notice: Subject to any disclaimer, the term of this patent is extended or adjusted under 35 U.S.C. 154(b) by 0 days.

(21) Appl. No.: 10/949,505

(22) Filed: Sep. 24, 2004

(65) Prior Publication Data

US 2005/0037695 A1 Feb. 17, 2005

Related U.S. Application Data

(63) Continuation of application No. 10/211,750, filed on Aug. 2, 2002, now abandoned.

(30) Foreign Application Priority Data

Feb. 3, 2000 (DE) ..... 100 04 455
Jan. 11, 2001 (EP) ..... PCT/EP01/00253

(51) Int. Cl.
*B24B 1/00* (2006.01)

(52) U.S. Cl. ..... 451/41; 451/42; 451/158; 451/159

(58) Field of Classification Search ..... 451/41, 451/42, 158, 159, 140, 143
See application file for complete search history.

(56) References Cited

U.S. PATENT DOCUMENTS 2,821,813 A * 2/1958 Degler ..... 451/120
2,836,939 A * 6/1958 White ..... 451/159
2,916,857 A * 12/1959 Dargie ..... 451/277
3,226,887 A * 1/1966 Rudd et al. ..... 451/42
3,330,075 A * 7/1967 Suddarth et al. ..... 451/277
3,589,078 A * 6/1971 Bala et al. ..... 451/4
3,624,969 A * 12/1971 Dalton ..... 451/159
3,874,123 A 4/1975 Hopkins et al.
3,877,177 A * 4/1975 Taniguchi ..... 451/159
3,886,696 A 6/1975 Bruck
3,897,703 A 8/1975 Phipps
3,900,971 A * 8/1975 Brueck ..... 451/239
3,968,598 A 7/1976 Ogawa
4,068,413 A * 1/1978 Suddarth ..... 451/159
4,128,968 A * 12/1978 Jones ..... 451/5

(Continued)

FOREIGN PATENT DOCUMENTS

CH 556719 12/1974

(Continued)

OTHER PUBLICATIONS

European Patent Search Report: EP 03 02 5546.

(Continued)

*Primary Examiner*—Maurina Rachuba
(74) *Attorney, Agent, or Firm*—Fish & Richardson P.C.

(57) ABSTRACT

A polishing head for polishing machines, in particular for polishing optical surfaces, has a polishing plate that is connected to a rotationally drivable drive shaft. The polishing plate is articulated to, and rotates with, the drive shaft. A ball hexagonal socket joint provides the articulated connection. Rotating by means of the articulated connection, the polishing plate can follow the surface of the workpiece to be processed, so that the polishing covering on the polishing plate always rests on a maximally large area on the surface of the workpiece.

24 Claims, 2 Drawing Sheets

U.S. PATENT DOCUMENTS

| | | | | | |
|---|---|---|---|---|---|
| 4,135,890 | A | * | 1/1979 | Billault | 451/277 |
| 4,166,342 | A | * | 9/1979 | Shaffer et al. | 451/163 |
| 4,173,848 | A | * | 11/1979 | Ikeno | 451/159 |
| 4,201,018 | A | * | 5/1980 | Pool | 451/389 |
| 4,232,485 | A | * | 11/1980 | Eadon-Allen | 451/159 |
| 4,392,331 | A | * | 7/1983 | Schimitzek et al. | 451/159 |
| 4,829,716 | A | | 5/1989 | Ueda et al. | |
| 4,956,944 | A | * | 9/1990 | Ando et al. | 451/5 |
| 4,974,368 | A | * | 12/1990 | Miyamoto et al. | 451/159 |
| 4,999,954 | A | * | 3/1991 | Miyamoto et al. | 451/5 |
| 5,069,081 | A | | 12/1991 | Morita | |
| 5,138,798 | A | | 8/1992 | Volat | |
| 5,154,020 | A | * | 10/1992 | Kajima | 451/159 |
| 5,347,763 | A | * | 9/1994 | Miyamato et al. | 451/241 |
| 5,421,770 | A | | 6/1995 | Bobst | |
| 5,695,393 | A | * | 12/1997 | Granziera | 451/390 |
| 5,759,457 | A | * | 6/1998 | Inoue et al. | 264/2.5 |
| 5,761,985 | A | | 6/1998 | Stoll | |
| 5,957,756 | A | * | 9/1999 | Figge et al. | 451/49 |
| 6,082,987 | A | * | 7/2000 | Su et al. | 425/150 |
| 6,089,713 | A | | 7/2000 | Hof et al. | |
| 6,165,057 | A | * | 12/2000 | Gill, Jr. | 451/287 |

FOREIGN PATENT DOCUMENTS

| | | | | |
|---|---|---|---|---|
| DE | 318561 | | | 1/1920 |
| DE | 1239211 | | | 10/1964 |
| DE | 1 239 211 | | | 4/1967 |
| DE | 2 252 503 | | | 5/1974 |
| DE | 27 42 307 | | | 3/1978 |
| DE | 41 01 132 | | | 7/1991 |
| DE | 689 03 661 | T2 | | 6/1993 |
| DE | 42 14 266 | | | 11/1993 |
| DE | 295 21 396 | U1 | | 8/1995 |
| DE | 44 42 181 | | | 10/1995 |
| DE | 295 21 396 | | | 2/1997 |
| DE | 298 03 158 | | | 8/1998 |
| DE | 694 16 943 | T2 | | 8/1999 |
| EP | 0 567 894 | | | 11/1993 |
| EP | 0 655 297 | B1 | | 3/1999 |
| EP | 1 251 997 | | | 10/2002 |
| GB | 1 011 741 | | | 12/1965 |
| JP | 63-232948 | | | 9/1988 |
| JP | 63232948 | | | 9/1988 |
| JP | 04244372 | | | 1/1991 |
| JP | 4-244372 | | | 9/1992 |
| JP | 2004/025314 | A | | 1/2004 |
| WO | WO 0032353 | | * | 6/2000 |
| WO | WO 01/56740 | | | 8/2001 |

OTHER PUBLICATIONS

Transcript of the Oral Argument for German Application No. 01 909 601.5 (Jun. 12, 2007) (English translation included).

European Search Report for European Application No. EP 03 02 5546, 2 pages (Dec. 3, 2003).

International Search Report for International Application No. PCT/EP01/00253, 4 pages (Jun. 22, 2001).

Office Action for German Application No. DE 101 00 860.0-14, 3 pages (Apr. 18, 2005) (English translation included).

Arguments in Support of Opposition for European Publication No. EP 1 251 997, 23 pages (Jan. 13, 2005) (English translation included).

Reply to the Arguments in Support of Opposition for European Publication No. EP 1 251 997, 33 pages (Nov. 2, 2005) (English translation included).

Supplement to the Arguments in Support of Opposition for European Publication No. EP 1 251 997, 11 pages (Jun. 19, 2006) (English translation included).

Reply to the Supplement to the Arguments in Support of Opposition for European Publication No. EP 1 251 997, 11 pages (Oct. 11, 2006) (English translation included).

Opinion of the Opposition Division for European Publication No. EP 1 251 997, 4 pages (Dec. 13, 2006) (English translation included).

Patent Proprietor's Written Statement for the Oral Hearing for European Publication No. EP 1 251 997, 20 pages (Mar. 7, 2007) (English translation included).

Opponent's Written Statement for the Oral Hearing for European Publication No. EP 1 251 997, 4 pages (Mar. 12, 2007) (English translation included).

Rascher et al., "IFHEM—Innovative Production Concept for High Tech Surfaces through the Use of MRF Technology," University of Applied Sciences Deggendorf, http://www.fhd.edu/transfer/archiv/forschungsbericht-2002/redmb.html, 1 page (retrieved from the Internet on Feb. 6, 2007) (English translation included).

H. Goersch, "Dictionary for Optometry," 2nd ed., Bode Pforzheim Publishers 2001. (English translation included).

Documents filed in European Patent Application No. 01 909 601.5: Statement of Grounds of Appeal in EP, submitted Oct. 18, 2007; Change of representative of objecting party, submitted Sep. 26, 2007; Appeal of Interim Decision, submitted Aug. 14, 2007. (English translation included).

Transcript of the Oral Argument for European Patent Application No. 01 909 601.5 (Jun. 12, 2007) (English translation included).

Documents related to Appeal No. T1365/07-3207 in EP Application 1251997, dated Mar. 7, 2008. (English translation included).

"*Optics and optical instrucments—Preparation of drawings for optical elements and systems*;" Part 12: Aspheric Surfaces, International Standard; Reference No. ISO 10110-12; Edition: Aug. 15, 1997.

Piegl et al., "*Monographs in Visual Communication*," The Nurbs Book, 2nd Edition, Springer 1997.

* cited by examiner

POLISHING HEAD FOR A POLISHING MACHINE

CROSS-REFERENCES TO RELATED APPLICATIONS

This is a Continuation Application to U.S. patent application Ser. No. 10/211,750, filed Aug. 2, 2002, which is now abandoned.

STATEMENT REGARDING FEDERALLY SPONSORED RESEARCH OR DEVELOPMENT

Not applicable.

BACKGROUND OF THE INVENTION

The invention relates to a polishing head for a polishing machine, and more particularly, for polishing optical surfaces.

A polishing machine for polishing spherical lens surfaces is known from EP 727 280 B1. This polishing machine has an upper slide, which can move in an x-direction. A tool spindle, which is mounted for rotation around a vertical axis, is connected to this slide. The tool spindle serves to receive a surfacing tool. A workpiece spindle, connected to a further slide, is provided for receiving the respective workpiece or lens. The workpiece spindle, and the tool spindle with the surfacing tool, are arranged at a fixed distance from one another. The slide carrying these two spindles can move in the z-direction.

A polishing machine and a process for polishing optical surfaces are known from WO 97/00155. The polishing machine has a polishing head, which is provided with an elastic diaphragm. The application of force to the surface to be polished is regulated by the application of pressure to the diaphragm. In this polishing machine, it is a disadvantage that the size of the surface of the respective polishing head or diaphragm abutting the surface to be polished depends on the application of pressure. The polishing head, with the elastic diaphragm, is prestressed toward the surface to be polished by an associated spring. Hydraulic cylinders are provided in order to provide a tilting motion of the elastic diaphragm around a point situated on the rotation axis in the region of the flexible diaphragm. The application of force to the surface to be polished is detected by associated sensors, strain gages and solenoids.

In the process known from this publication, the polishing of the optical surface is controlled in dependence on the rotational speed of the polishing head, and the pressing force acting on the surface to be polished is controlled by means of the application of pressure.

SUMMARY OF THE INVENTION

The invention has as its object to provide a polishing head for polishing a free-form surface, by means of which a qualitatively high-value optical surface can be polished, and by the use of which a constant polishing removal over the whole optical surface to be polished can be ensured.

The object of the invention is attained by a polishing head, in particular for polishing optical surfaces, comprising a polishing plate having an articulated connection to a rotationally drivable drive shaft, wherein the polishing plate is connected to rotate with the drive shaft and articulated for the execution of tilting motions.

By means of the feature that the polishing plate is connected, articulated to rotate with the drive shaft, it is possible for the polishing plate to rest on the surface to be processed, following the surface contour. Due to the articulated connection, the polishing plate can execute tilting motions, so that it rests on a maximum polishing surface on the surface to be polished.

For the transmission of the rotational motion of the drive shaft to the polishing plate, the polishing plate is connected to the drive shaft by positive locking, so that the rotational motion of the drive shaft is transmitted to the polishing plate due to the positive locking.

The articulated, commonly rotating connection is connected to the polishing plate to rotate with the drive shaft by means of a ball hexagonal socket joint. It is possible by means of this ball hexagonal socket joint to arrange the pivot point, around which the polishing plate can be pivoted in optional directions, as close as possible to the polishing surface of the polishing plate. The arrangement of the articulated connection close to the polishing surface of the polishing plate has the advantage that the polishing plate can react quickly in following the surface contours.

One or more latch elements are assigned to the articulated connection, for securing the connection between the drive shaft and the polishing head. If a ball hexagonal socket joint is provided as the articulated connection, it is ensured by means of the latch element that the ball head cannot slip out of the associated recess. There are then no problems in removing the polishing plate from the surface to be polished. Furthermore, different polishing heads can easily be exchanged, due to the releasability of the connection ensured by the latch element.

A pressure chamber is arranged for the polishing head, so that a translational motion of the polishing plate along a mid-axis of the polishing head results from pressurizing the pressure chamber.

A piston allocated to the pressure chamber is effectively connected to the drive shaft, so that the application of pressure to the pressure chamber is transmitted via the drive shaft to the polishing plate.

The drive shaft drives by means of a coaxially arranged hollow cylinder with which the drive shaft is mounted to rotate. A positive connection transmits the rotary motion.

The drive shaft is mounted in the hollow cylinder by means of mounting elements, e.g., a roller bearing or a ball bearing. By this mounting the drive shaft can have a smooth-running translational motion, and accordingly the initiated translational motion is nearly completely transmitted to the polishing plate.

BRIEF DESCRIPTION OF THE DRAWINGS

The invention is described in detail hereinbelow with reference to an embodiment example.

DETAILED DESCRIPTION OF THE INVENTION

Figure 1:
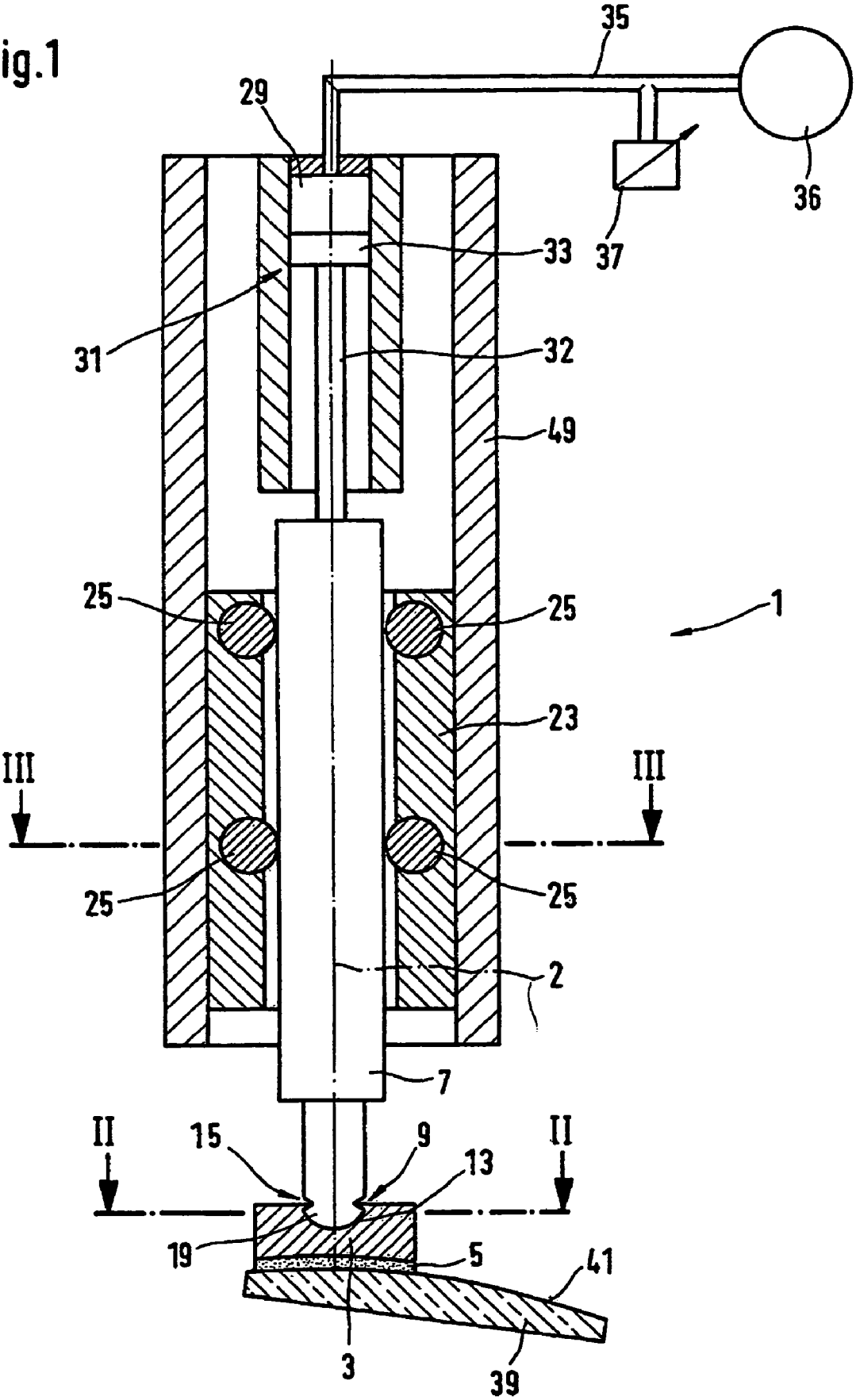
FIG. 1 shows a schematic sketch of the polishing head in a section containing its mid-axis.
Figure 2:
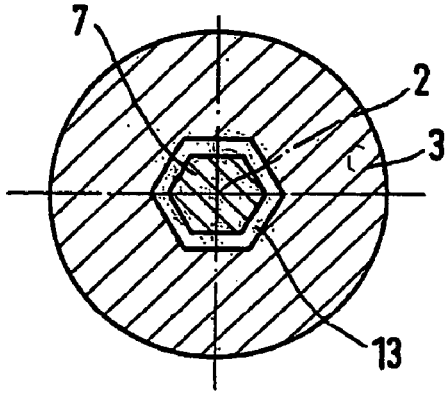
FIG. 2 shows a section along the plane II-II in FIG. 1.
Figure 3:
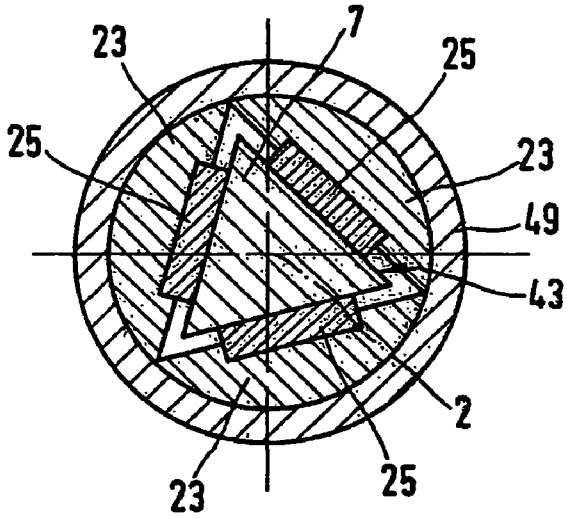
FIG. 3 shows a section along the plane III-III in FIG. 1.

The polishing head (1) shown in FIG. 1 has a polishing plate (3) with a polishing covering (5). The polishing covering (5) rests on a surface (41) of a workpiece (39) to be polished.

The polishing plate (3) is received on a drive shaft (7) via the articulated connection. In this embodiment example shown, a ball hexagonal socket joint is provided for this commonly rotatable articulated connection. For this purpose, the drive shaft (7) is provided at the end, on the side facing toward the polishing plate, with a ball head (19) that engages in a recess (13) formed in the polishing plate (3).

For securement, the connection between the ball head (19) and the polishing plate (3) is secured by means of a latch element (15). A spring element or spring pin on the polishing plate, projecting into a recess on the ball head, can for example be provided as the latch element.

It is also possible to constitute the ball head on the polishing plate (19); in this case, a recess is then provided in the drive shaft (7) for rotationally secure, articulated reception of the ball head. In this case, the distance between the joint place—i.e., the point around which a tilting of the polishing plate relative to the rigid drive shaft can take place—and the surface (41) to be polished is of course greater.

The drive shaft (7) can be displaced translationally by means of the mounting element (23) and is mounted in, and to rotate with, a hollow cylinder (49). The hollow cylinder (49) is driven rotationally by means of a drive (not shown) of the polishing machine, the rotational motion being fully transmitted to the drive shaft (7) for the polishing head due to the rotationally secured connection by means of the mounting element (23).

A hydraulic or pneumatic system, which serves to act on the polishing head with the required polishing pressure, is provided in the hollow cylinder (49) on the side of the drive shaft (7) remote from the polishing head. This system has a pressure chamber cylinder (31) with a translationally displaceable piston (33) received therein. To decouple the piston (33) from the rotary motion of the drive shaft (7) and of the hollow cylinder, swivel bearings can be provided between the pressure chamber cylinder (31) and the hollow cylinder (49) and also between the connecting rod (32) driven by the piston (33) and the drive shaft (7). A pressure supply (35) with a pressure control valve (37) and a pressure reservoir (36) is arranged for the pressure chamber (29) formed in the pressure chamber cylinder (31), to apply pressure to the piston (33). A force on the piston (33), directed along a mid-axis (2) of the polishing head (1), is initiated by applying pressure to the pressure chamber (29). There results from this force a respective translational motion of the polishing plate or increase of the effective polishing pressure, provided that the polishing covering (5) rests on an optical surface (41) of a workpiece (39) to be polished.

The translationally movable coupling for the hollow cylinder (49) to rotate with the drive shaft (7) takes place by means of a roller bearing element (23). The drive shaft (7) has for this purpose an external profile (43) that is noncircular, preferably a polygonal profile. The positive connection between the external profile (43) of the drive shaft (7) and the inner wall of the hollow cylinder is attained by means of rollers or cylinders (25) which are received in the bearing element (23) symmetrically of the external profile of the drive shaft (7) and which roll on the external profile of the drive shaft. The rotation axes of the rollers or cylinders are then directed perpendicular to the rotation axis of the drive shaft (7). In some embodiments, the polishing process can include a body to be processed with approximately the same rotational frequency as the polishing plate. In certain embodiments, the polishing process can include varying a rotational frequency of the rotary plate or of the optical surface to be polished in dependence on a radial position of the polishing plate.

Figure 4:
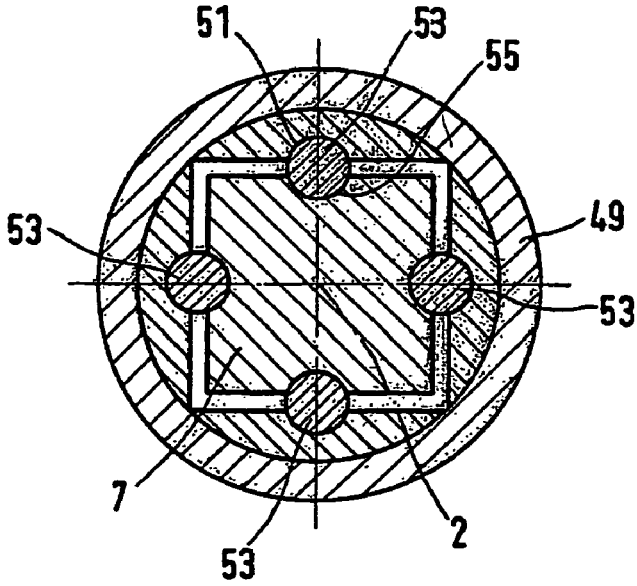
FIG. 4 shows a section along the plane III-III, in an alternative example.

Instead of the cylinder mounting of the drive shaft (7) in the hollow cylinder (49), a ball mounting can also be provided, as shown in FIG. 4. For a translationally displaceable connection, rotatable in common, the balls (53) are mounted in longitudinal grooves (51) of the hollow cylinder (49) and further longitudinal grooves (55) of the drive shaft (7), with the longitudinal grooves extending parallel to the rotation axis of the drive shaft (7). In this case also, the drive shaft has a non-rotationally-symmetrical external profile, in particular a polygonal profile, at least in a region corresponding to the mounting.

The polishing process is described in detail hereinafter. For polishing, the polishing head, the diameter of which is smaller than the diameter of the surface to be polished, moves in a swiveling motion in the radial direction over the optical surface (41) to be polished. Both the workpiece (39) and the polishing plate are driven with nearly equal rotational speed in an identical direction. When the polishing plate moves over the optical surface (41) to be polished, it can be provided to vary the rotational speeds of the polishing plate or the rotational speed of the workpiece, in particular in dependence on the radial position of the polishing plate. This variation of rotational speed has a positive effect on a constant polishing removal.

The pressure fluctuations are kept very small by the choice of a very large reservoir volume (36) in comparison with the varying volume of the piston (31), so that the polishing plate rests with a constant force on the optical surface to be polished. The pressure-regulating valve also contributes to the equalization of pressure fluctuations.

By means of the arrangement described, in connection with a prior art polishing machine, in particular optical surfaces (41) which are noncircular can be polished, the polishing removal being constant over the whole optical surface. It is necessary for the uniform polishing removal that the polishing covering of the polishing plate (3) rests on the optical surface (41) to be polished over as large as possible a surface. This is in particular ensured in that, by means of the articulated connection of the polishing plate to rotate with the drive shaft (7), the polishing plate can be tilted about a point situated on the mid-axis (2) of the polishing head, and the alignment of the polishing plate can thereby follow the surface contour of the surface (41) to be polished.

List of Reference Numerals

| | | | |
|---|---|---|---|
| 1 | polishing head | 32 | connecting rod |
| 2 | mid-axis | 33 | piston |
| 3 | polishing plate | 35 | pressure supply |
| 5 | polishing covering (~covering) | 36 | resevoir |
| 7 | drive shaft | 37 | pressure regulating valve |
| 9 | articulated connection | 39 | workpiece |
| 15 | recess in polishing plate | 41 | optical surface |
| 19 | ball head | 43 | external profile |
| 20 | recess | 49 | hollow cylinder |
| 23 | mounting elements | 51 | longitudinal grooves |
| 25 | cylinders or rollers | 53 | balls |
| 29 | pressure chamber | 55 | longitudinal groove in drive shaft |
| 31 | pressure chamber cylinder | | |

I claim:

1. A process for polishing a point-asymmetrical free-form optical surface comprising rotationally driving a polishing plate relative to the optical surface to be polished, the polishing plate being rotationally driven in the same direction of rotation as the optical surface to be polished, wherein the process further comprises controlling pressure in a pressure chamber in dependence on a surface contour of the optical surface, so that the polishing plate resting on the optical surface exerts a predetermined constant polishing pressure on the optical surface.

2. The process according to claim 1, comprising driving the optical surface to be polished with approximately the same rotational frequency as the polishing plate.

3. The process according to claim 1, comprising executing a radial motion of the polishing plate to the optical surface to be polished.

4. The process according to claim 1, comprising varying a rotational frequency of the polishing plate or of the optical surface to be polished in dependence on a radial position of the polishing plate.

5. The process according to claim 1, comprising using a polishing head with a polishing plate having an articulated connection to a rotationally drivable shaft, wherein the polishing plate is connected to rotate with the drive shaft for the execution of tilting motions.

6. A process, comprising:

rotationally driving a polishing plate relative to a point-asymmetrical free-form optical surface to polish the point-asymmetrical free-form optical surface, the polishing plate having an articulated connection to a rotationally drivable drive shaft so that the polishing plate rotates with the drive shaft to execute tilting motions; and controlling pressure in a pressure chamber in dependence on a surface contour of the optical surface so that the polishing plate exerts a predetermined constant polishing pressure on the optical surface.

7. The process according to claim 1, wherein the pressure chamber is a fluid pressure chamber in which a piston is disposed, and the fluid pressure chamber and piston are arranged so that applying fluid pressure to the fluid pressure chamber moves the piston along a longitudinal axis of a polishing head and causes translational motion of the polishing plate along the longitudinal axis of the polishing head.

8. The process according to claim 7, further comprising regulating pressure within the fluid pressure chamber by allowing fluid to be transferred between the fluid pressure chamber and a reservoir that is in fluid communication with the fluid pressure chamber, the reservoir having a first volume and the fluid pressure chamber having a second volume, the first volume being substantially greater than the second volume.

9. The process according to claim 7, further comprising regulating pressure within the fluid pressure chamber using a valve.

10. The process according to claim 9, wherein a reservoir is in fluid communication with the fluid pressure chamber, and the valve is positioned between the reservoir and the fluid pressure chamber.

11. The process according to claim 10, wherein the reservoir has a first volume and the fluid pressure chamber has a second volume, the first volume being substantially greater than the second volume.

12. The process according to claim 6, wherein the pressure chamber is a fluid pressure chamber in which a piston is disposed, and the fluid pressure chamber and piston are arranged so that applying fluid pressure to the fluid pressure chamber moves the piston along a longitudinal axis of a polishing head and causes translational motion of the polishing plate along the longitudinal axis of the polishing head.

13. The process according to claim 12, further comprising regulating pressure within the fluid pressure chamber by allowing fluid to be transferred between the fluid pressure chamber and a reservoir that is in fluid communication with the fluid pressure chamber, the reservoir having a first volume and the fluid pressure chamber having a second volume, the first volume being substantially greater than the second volume.

14. The process according to claim 11, further comprising regulating pressure within the fluid pressure chamber using a valve.

15. The process according to claim 14, wherein a reservoir is in fluid communication with the fluid pressure chamber, and the valve is positioned between the reservoir and the fluid pressure chamber.

16. The process according to claim 15, wherein the reservoir has a first volume and the fluid pressure chamber has a second volume, the first volume being substantially greater than the second volume.

17. The process according to claim 1, wherein the polishing plate is connected to a rotationally drivable drive shaft that is at least partially disposed within a hollow cylinder, the drive shaft being axially movable relative to the hollow cylinder.

18. The process according to claim 17, wherein rollers are positioned between the drive shaft and the hollow cylinder, the rollers providing a low-friction connection between the drive shaft and the hollow cylinder.

19. The process according to claim 18, wherein the polishing plate and the drive shaft are connected via a ball and socket joint.

20. The process according to claim 6, wherein the drive shaft is at least partially disposed within a hollow cylinder, the drive shaft being axially movable relative to the hollow cylinder.

21. The process according to claim 20, wherein rollers are positioned between the drive shaft and the hollow cylinder, the rollers providing a low-friction connection between the drive shaft and the hollow cylinder.

22. The process according to claim 20, wherein the polishing plate and the drive shaft are connected via a ball and socket joint.

23. The process according to claim 20, wherein rotationally driving the polishing plate comprises rotating the hollow cylinder, the drive shaft being rotationally fixed relative to the hollow cylinder.

24. The process according to claim 17, wherein rotationally driving the polishing plate comprises rotating the hollow cylinder, the drive shaft being rotationally fixed relative to the hollow cylinder.

* * * * *

UNITED STATES PATENT AND TRADEMARK OFFICE

CERTIFICATE OF CORRECTION

PATENT NO. : 7,588,480 B2
APPLICATION NO. : 10/949505
DATED : September 15, 2009
INVENTOR(S) : Kuebler It is certified that error appears in the above-identified patent and that said Letters Patent is hereby corrected as shown below:

Title pg, Item (56) Ref Cited, Page 2, Column 2, Line 44, delete "instrucments" insert --instruments--.

Column 4, Line 48, delete "resevoir" insert --reservoir--.

Signed and Sealed this

Twenty-second Day of December, 2009

David J. Kappos

David J. Kappos
*Director of the United States Patent and Trademark Office*